United States Patent [19]

Docktor et al.

[11] Patent Number: 4,664,771

[45] Date of Patent: May 12, 1987

[54] ANODIZING CLIP

[75] Inventors: Kenneth E. Docktor; Robert J. Pulido, both of Hayward, Calif.

[73] Assignee: Criton Technologies, Bellevue, Wash.

[21] Appl. No.: 734,636

[22] Filed: May 15, 1985 (Under 37 CFR 1.47)

[51] Int. Cl.[4] ..... C25D 17/08

[52] U.S. Cl. ..... 204/297 W; 204/297 R; 248/229; 248/231

[58] Field of Search ..... 204/297 R, 297 W; 248/229, 230, 231, 231.8, 316.7; 339/251, 252, 255 R; 269/130–132, 254 R

[56] References Cited

U.S. PATENT DOCUMENTS

| | | | |
|---|---|---|---|
| 1,955,127 | 4/1934 | Heintz | 248/231 |
| 2,451,702 | 10/1948 | Weigand | 269/215 |
| 2,611,949 | 9/1952 | Wanamaker | 269/130 |
| 2,847,378 | 8/1958 | Mundell | 204/297 W |
| 3,013,959 | 12/1961 | Ventre | 204/297 W |
| 3,108,058 | 10/1963 | Mines et al. | 204/297 W |
| 3,241,800 | 3/1966 | Richter, III | 248/231 |
| 3,631,604 | 1/1972 | Schenavar | 248/231 |
| 4,077,865 | 3/1978 | Müller | 204/297 W |
| 4,085,997 | 4/1978 | Hainsworth | 204/297 W |
| 4,176,039 | 11/1979 | Wismer | 204/297 W |
| 4,309,263 | 1/1982 | Boyd | 248/231 |
| 4,348,000 | 9/1982 | Hanner | 248/231 |

FOREIGN PATENT DOCUMENTS

| | | | |
|---|---|---|---|
| 2731699 | 2/1978 | Fed. Rep. of Germany | 204/297 W |

*Primary Examiner*—Terryence Chapman
*Attorney, Agent, or Firm*—Townsend and Townsend

[57] ABSTRACT

The anodizing clip includes an elongate body having inner and outer surfaces. The inner surface has teeth at either end. A flexible, strong elastic band has first and second ends removably secured to the body and sized to pass around a rack member of an anodizing rack. A workpiece is placed between the teeth of the body and the rack member and is held in place by the force of the elastic band. Insertion and removal of workpieces between the rack member and the teeth on the body of the anodizing clip is preferably accomplished using a release tool to gain a mechanical advantage.

11 Claims, 4 Drawing Figures

ANODIZING CLIP

BACKGROUND OF THE INVENTION

The present invention relates to anodizing systems, specifically a clip used to secure workpieces to the racking used to suspend the workpieces in the baths.

A metal workpiece is anodized by passing an electric current through it while immersed in an appropriate bath to deposit a protective oxide coating on the surface. Most commonly this is done to protect aluminum parts, especially those subjected to a marine environment. To do so, workpieces are secured to what is commonly called racking. Racking typically includes a horizontal rack member, to which is secured an electrical bus bar, and two or more vertically depending rack members. Workpieces, such as elongate framing members used for commercial window frames, are then positioned horizontally and secured to two or more vertical rack members typically using a variety of specially designed C-clamps.

Several problems arise when using C-clamps to secure workpieces to a rack member. First, the user must manually position and secure the rack member and the workpiece between the clamping faces of the C-clamp; this is quite time consuming. Second, it has been found that when the C-clamps are removed, they are often dropped on the floor by the workers. This clutters the floor causing a safety problem. Third, dropped clamps must be gathered up from the floor when it comes time to mount more workpieces to the racking to further reduce efficiency.

Another type of clamping device has been used in Italy to secure workpieces to racking. It looks like a giant clothespin or alligator clip. A wide rubber band is placed over the jaws of the device to bias the jaws closed. However the design limits the range of sizes of workpieces with which it can be used. Also, it has a tendency to slip off as it moves through the anodizing baths.

SUMMARY OF THE INVENTION

The present invention is directed to an anodizing clip which is simply and quickly mounted to a rack member using a flexible elastic band. Workpieces can be quickly and securely mounted to the rack member by the clip. There is no need to individually adjust the clip for each workpiece. The elastic band is preferably sized so the clip remains in position on the rack member after the workpieces have been removed. Thus, compared with the prior art specialized C-clamps, the anodizing clip is much simpler and quicker to use and eliminates the safety problem of dropped clamps on the floor.

The anodizing clip includes an elongate body having inner and outer surfaces. The inner surface preferably is roughened, such as with teeth, at either end. The flexible elastic band has first and second ends attached to the body and is sized to pass around the rack member of an anodizing rack. This allows the clip to be mounted anywhere along the length of a rack member. A workpiece placed between the teeth of the body and the rack member is held in place by the force of the elastic band.

Insertion and removal of workpieces between the rack member and the teeth on the body of the anodizing clip is preferably accomplished using a release tool to gain a mechanical advantage since the force exerted by the elastic band is quite substantial. One release tool design has a U-shaped opening at one end sized to fit around the side of the body and engage the inner and outer surfaces of the body. This provides the extra leverage needed to pivot an end of the body of the clip away from the workpiece or rack member.

A primary feature of the invention is the use of a flexible elastic band having first and second ends secured to the sides of an elongate body to form the clip. The resulting structure is simple, easy to mount to the rack members, simple to use and relatively inexpensive to manufacture. The flexible elastic band is of a material which withstands repeated immersions in the anodizing baths without losing its strength or flexibility. Using a simple release tool, a worker can quickly and easily pivot either end of the body away from a clamped workpiece or the rack member.

Other features and advantages of the present invention will appear from the following description in which the preferred embodiment has been set forth in detail in conjunction with the accompanying drawing.

DETAILED DESCRIPTION OF THE PREFERRED EMBODIMENT

Figure 2:
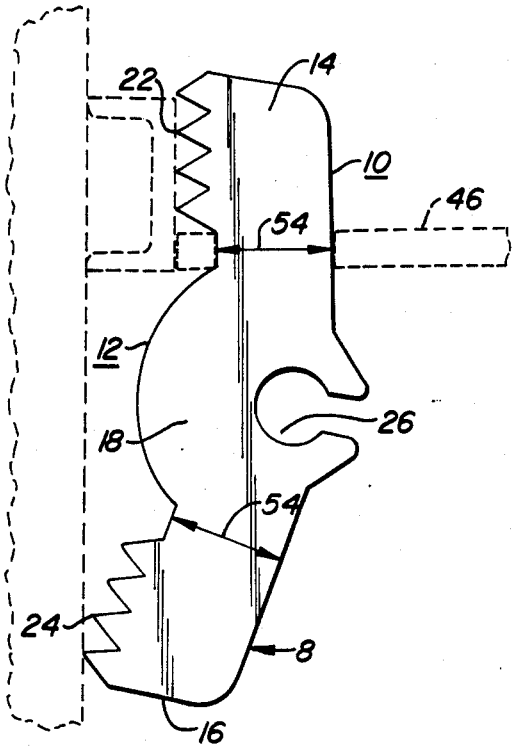
FIG. 2 is a side view of the body of the anodizing clip of FIG. 1 showing a release tool mounted to the body in dashed lines.

Turning now to the figures, anodizing clip 2 is shown mounted to a vertical rack member 4 and securing a workpiece 6 between the body 8 of clip 2 and rack member 4. Body 8, as seen in FIG. 2, is an elongate member having an outer surface 10, an inner surface 12, ends 14, 16 and sides 18, 20. Body 8 is typically made of aluminum. Inner surface 12 has toothed portions 22, 24 adjacent ends 14, 16. A slotted bolt hole 26 is formed by outer surface 10. Although only one workpiece 6 is shown in the drawing, workpieces may be mounted between both tooth portions 22, 24 at each end 14, 16 of body 8.

A bolt fastener 28, made of nylon, passes through slotted bolt hole 26 and has a head 30 at one end and a threaded wing nut 32 at the other. A flexible elastic band 34 has eye slits 40, 42 formed near first and second ends 36, 38. A shaft 44 of bolt fastener 28 passes through eye slits 40, 42. Head 30 and wing nut 32 keep ends 36, 38 secured to bolt fastener 28.

Flexible elastic band 34, when anodizing aluminum, can be made from a rubber sold as stock number 2080 by The American Rubber Mfg. Co. of Emeryville, Calif. Band 34 is preferably sized so that when a workpiece 6 is not between toothed portions 22 or 24 and rack member 4, then band 34 keeps clip 2 from sliding down rack member 4 and thus properly positioned when needed again.

Figure 1:
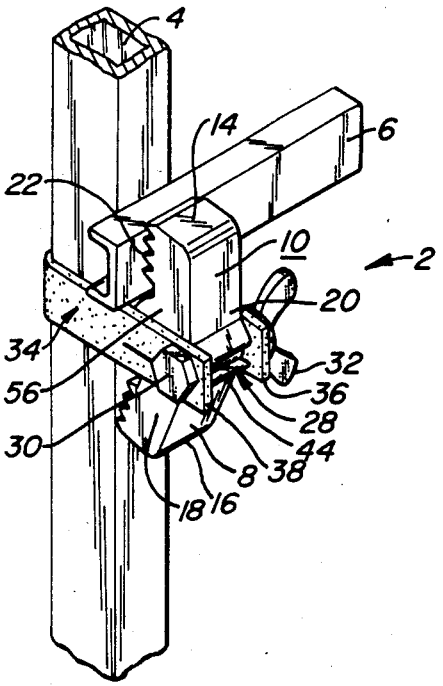
FIG. 1 is an isometric view showing an anodizing clip made according to the invention securing a workpiece to a vertical rack member.
Figure 3:
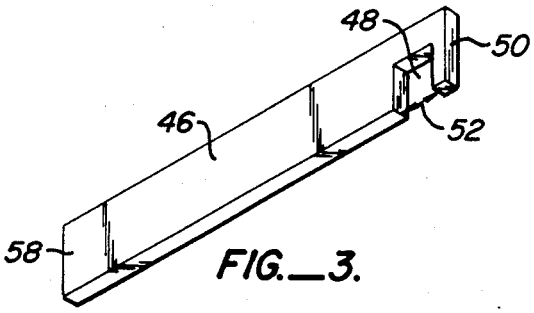
FIG. 3 is an isometric view of a release tool used with the anodizing clip of FIG. 1.
Figure 4:
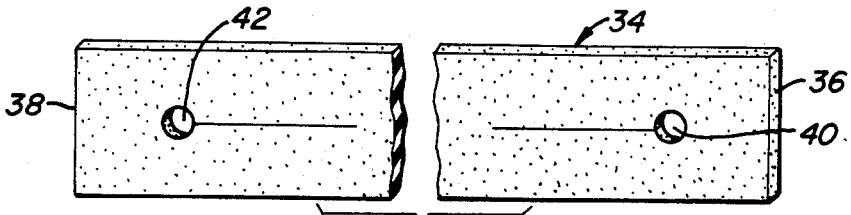
FIG. 4 is an isometric view of the elastic band of FIG. 1.

Since elastic band 34 is quite strong, a release tool 46, shown in FIG. 3, is used to bias ends 14, 16 away from member 4. Release tool 46 has a slot 48 formed adjacent its outer end 50. Slot 48 has a width 52 which is slightly larger than a dimension 54 between outer surface 10 and inner surface 12 of body 8. To release workpiece 6 from between toothed portion 22 and rack member 4, the worker places outer end 50 of release tool 46 over body 8 at a position 56 and then pivots the handle 58 of release tool 46 downwardly, referencing FIG. 1, to bias tooth portion 22 away from workpiece 6 allowing workpiece 6 to be removed. Upon pivoting release tool 46 back again, band 34 biases tooth portion 22 against vertical rack member keeping anodizing clip 2 positioned on rack 4 until another job must be racked. Release tool 46 is similarly used to bias tooth portions 22, 24 away from rack member 4 to allow workpieces to be mounted between the tooth portions and the rack member.

It is preferred that elastic band 34 be sized so that when no workpiece is mounted between body 8 and rack member 4, the elastic band still maintains the clip in position. However, depending on the size of the workpiece and the particular configuration of the body of the anodizing clip, this may not always be possible.

Modification and variation can be made to the disclosed embodiment without departing from the subject of the invention as defined in the following claims. For example, other types of release tools may be used in lieu of the slotted tool shown. Also, other methods of securing ends 36, 38 of flexible elastic band 34 to body 8 can be used. Inner surface 12 adjacent ends 14, 16 can have a roughened character other than toothed surfaces 22, 24. More than one slit 40, 42 may be formed at the ends of band 34 to allow the tension to be adjusted and to suit the size of workpiece 6.

We claim:

1. A racking assembly, for use in annodizing a workpiece, comprising:

racking, including a rack member;

electrical current means connected to the racking; and an anodizing clip for securing the workpiece to be anodized to the rack member comprising:

a body having a workpiece engaging portion;

a flexible elastic band having first and second ends; and means for securing said band to said body with said band passing about the rack member to bias the workpiece engaging portion against the rack member thereby securing the workpiece to rack member.

2. The assembly of claim 1 wherein the body includes first and second, spaced apart workpiece engaging portions and a central portion in between.

3. The assembly of claim 2 wherein the band is secured to the body at the central portion.

4. The assembly of claim 1 wherein the workpiece engaging portion has a saw-toothed workpiece engaging surface.

5. The assembly of claim 1 wherein the band is made of rubber.

6. The assembly of claim 1 further comprising a removal tool for biasing the workpiece engaging portion away from the rack member.

7. The assembly of claim 1 wherein the securing means includes means for attaching the first and second band ends to the body.

8. The assembly of claim 7 wherein the attaching means includes first and second attachment points and the band has attachment openings at the first and second band ends for mounting to the attachment points.

9. The assembly of claim 8 wherein the attachment points are at either end of a bolt and nut combination passing through the body.

10. The assembly of claim 1 wherein the body has an inner surface facing the rack member and an outer surface facing away from the rack member, portions of the inner and outer surface spaced apart at a chosen distance for engagement by a release tool.

11. A racking assembly, for use in anodizing a workpiece, comprising:

racking, including a rack member;

electrical current means connected to the racking; and an anodizing clip assembly for securing the workpiece to be anodized to the rack member comprising:

a body having first and second, spaced apart workpiece engaging portions and a central portion in between, the workpiece engaging portions having roughened workpiece engaging surfaces;

a flexible rubber band having first and second ends;

means for securing the first and second ends of said band to the central portion of said body with said band passing about the rack member to bias the workpiece engaging portions against the rack member thereby securing the workpiece, placed between one of said workpiece engaging portions and the rack member, to the rack member; and a removal tool for biasing the workpiece engaging portion away from the rack member.

* * * * *